US006718735B2

(12) United States Patent
Lewis, Jr. et al.

(10) Patent No.: US 6,718,735 B2
(45) Date of Patent: Apr. 13, 2004

(54) ALBUMIN IN A FLEXIBLE POLYMERIC CONTAINER

(75) Inventors: James D. Lewis, Jr., Antioch, IL (US); William Baccia, McHenry, IL (US); Josef Schmidt, Green Oaks, IL (US); Johan Vandersande, Newhall, CA (US); John Carl Card, Washington, MI (US); Theodor Langer, Vienna (AT); Georg Habison, Vienna (AT); Helmut Eder, Kufstein (AT)

(73) Assignees: Baxter International Inc., Deerfield, IL (US); Baxter Healthcare S.A., Zurich (CH)

( * ) Notice: Subject to any disclaimer, the term of this patent is extended or adjusted under 35 U.S.C. 154(b) by 0 days.

(21) Appl. No.: 10/101,490

(22) Filed: Mar. 19, 2002

(65) Prior Publication Data

US 2003/0177739 A1 Sep. 25, 2003

(51) Int. Cl.[7] ..... B65B 55/10; B65B 9/06

(52) U.S. Cl. ..... 53/425; 53/434; 53/440; 53/451; 53/469

(58) Field of Search ..... 53/425, 426, 410, 53/451, 412, 469, 133.2, 479, 141, 167, 551, 374.3, 375.9, 434, 440; 206/438; 604/408, 410

(56) References Cited

U.S. PATENT DOCUMENTS 3,643,586 A * 2/1972 Robinson
3,826,061 A 7/1974 Hunter
4,049,033 A * 9/1977 Ralston, Jr.
4,136,094 A * 1/1979 Condie
4,191,231 A * 3/1980 Winchell et al.

(List continued on next page.)

FOREIGN PATENT DOCUMENTS

| | | |
|---|---|---|
| EP | 286 276 A | 10/1988 |
| EP | 296 889 A1 | 12/1988 |
| EP | 0 240 563 B1 | 5/1990 |
| EP | 296 889 B1 | 7/1992 |

OTHER PUBLICATIONS

Baxter slide presented at Mar. 15, 2001 Stock Analysis Meeting.

Baxter slide presented at Mar. 26, 2001 Growth Conference.

*Primary Examiner*—Stephen F. Gerrity
(74) *Attorney, Agent, or Firm*—Wallenstein Wagner & Rockey, Ltd.

(57) ABSTRACT

A flexible polymeric container for holding albumin. The container is made of a sheet of flexible polymeric film formed into a bag having a cavity enclosed by a first wall, an opposing second wall, and seals about a periphery of the first and second walls. The seals join an interior portion of the opposing first and second walls and create a fluid-tight chamber within the cavity of the container for storing a concentration of the albumin. A method of packaging the albumin protein into a flexible polymeric container is also provided. Therein a flexible polymeric material is converted into bags, the bags are filled with a quantity of albumin by a filler, and a seal area of the bags is sealed to enclose the albumin within the bag.

36 Claims, 4 Drawing Sheets

U.S. PATENT DOCUMENTS 4,253,458 A * 3/1981 Bacehowski et al.
4,480,751 A * 11/1984 Lueptow
4,603,536 A 8/1986 de la Poype
4,630,429 A 12/1986 Christine
4,654,240 A 3/1987 Johnston
4,686,125 A 8/1987 Johnston et al.
4,692,361 A 9/1987 Johnston et al.
4,695,337 A 9/1987 Christine
4,710,157 A 12/1987 Posey
4,761,197 A 8/1988 Christine et al.
4,778,697 A 10/1988 Genske et al.
4,779,397 A 10/1988 Christine et al.
4,794,750 A 1/1989 Schmidt et al.
4,828,892 A 5/1989 Kersten et al.
4,856,259 A 8/1989 Woo et al.
4,856,260 A 8/1989 Woo et al.
4,887,411 A 12/1989 Rondeau et al.
4,887,973 A 12/1989 Susini et al.
4,888,155 A 12/1989 Posey et al.
4,902,269 A 2/1990 Susini et al.
4,924,891 A 5/1990 Soubrier et al.
4,946,432 A 8/1990 Susini et al.
4,964,944 A 10/1990 Christine et al.
4,969,882 A * 11/1990 Carmen et al.
4,981,463 A 1/1991 Susini et al.
5,071,686 A 12/1991 Genske et al.
D324,566 S 3/1992 Schmidt et al.
5,193,593 A 3/1993 Denis et al.
5,203,819 A 4/1993 Gleason
5,300,060 A * 4/1994 Nelson
5,306,269 A * 4/1994 Lewis et al.
5,334,180 A 8/1994 Adolf et al.
5,454,208 A 10/1995 Kawano
5,493,845 A 2/1996 Adolf et al.
5,514,123 A 5/1996 Adolf et al.
5,697,407 A 12/1997 Lasonde
5,846,930 A * 12/1998 Ristol Debart et al.
6,197,936 B1 * 3/2001 Sano et al.
6,326,010 B1 * 12/2001 Sano et al.
2002/0124526 A1 * 9/2002 Lewis, Jr. et al. ..... 53/396

* cited by examiner

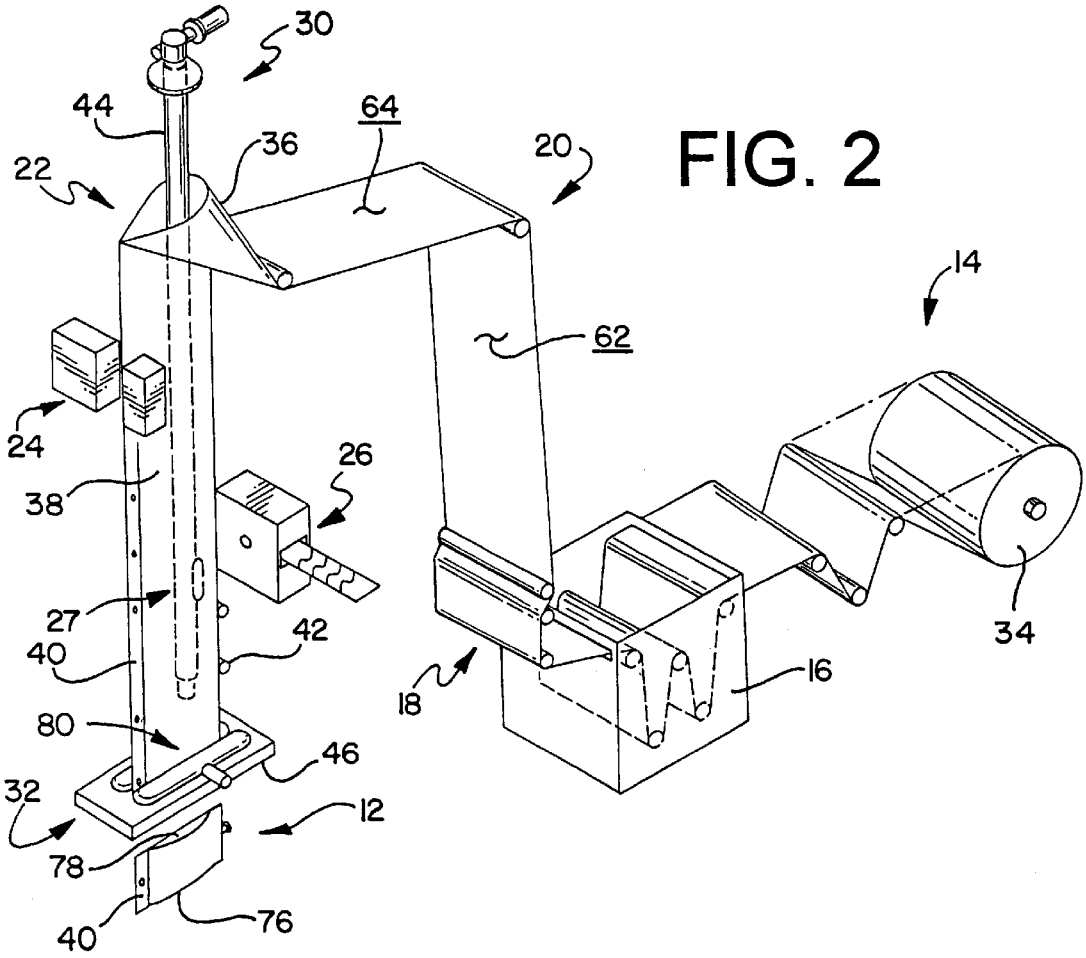
FIG. 2
FIG. 3
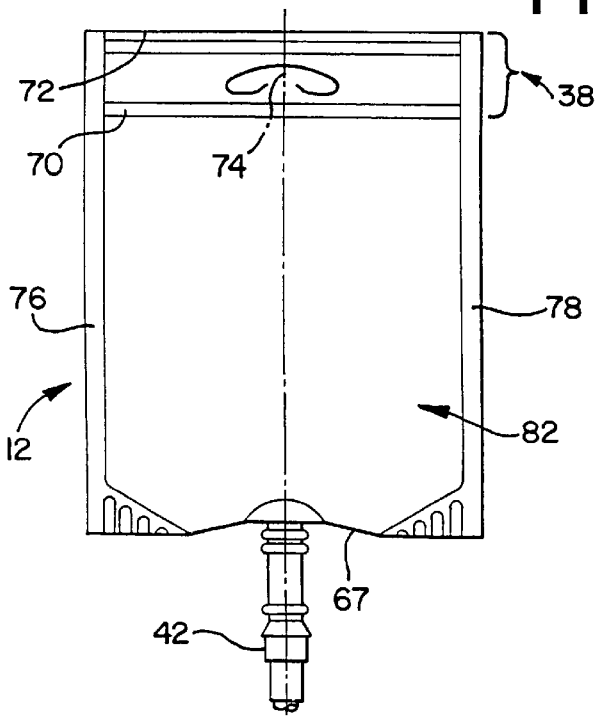
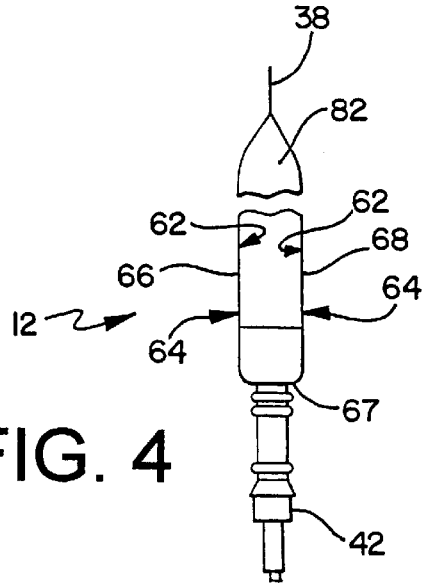
FIG. 4

ALBUMIN IN A FLEXIBLE POLYMERIC CONTAINER

DESCRIPTION

1. Technical Field

The present invention relates generally to the packaging of a protein in a flexible polymeric container, and more specifically to the mass-packaging of albumin in flexible polymeric containers in an aseptic environment of a form-fill-seal packaging machine.

2. Background of the Invention

Many peptides and proteins for pharmaceutical or other use are known, including glycoproteins, lipoproteins, imunoglobulins, monoclonal antibodies, enzymes, blood proteins, receptor proteins, and hormones.

One type of such compound is albumin. Albumin is a sulfur-containing, water-soluble protein that congeals when heated, and occurs in blood. Albumin is often utilized as a blood expander to assist in maintaining a patient's blood pressure, or sometimes to assist with increasing a patient's blood pressure during blood loss.

Proteins, such as albumin, are adsorbed by most man-made materials, including liquid containers made of various polymers. Adsorption of the protein onto the artificial polymeric surface results in a lowering of the protein content of that solution. Some protein solutions can be adversely affected by protein adsorption onto artificial surfaces through a process called denaturing. Denaturing is a process whereby the protein is not permanently adsorbed onto the polymeric container, but rather the protein molecules are adsorbed onto the container and then released. The adsorption and release can change the shape of the molecule (i.e., denature it). Often, when protein molecules in drug solutions have undergone denaturing, they may lose their efficacy and utility. Accordingly, to date proteins such as albumin have been stored for individual use in glass vials in order to avoid the risk of denaturing. Because of the cost encountered in producing, packaging, boxing, shipping and storing glass vials, as well as the cost and weight of the glass vial, and the ease with which the glass vial may break, a more efficient, inexpensive and user friendly means of packaging proteins such as albumin to possibly eliminate the above drawbacks is desirable.

One type of packaging utilized for packaging non-protein pharmaceuticals is polymeric bags formed with a form-fill-seal packaging machine. Form-fill-seal packaging machines are typically utilized to package a product in a flexible container. The form-fill-seal packaging machine provides an apparatus for packaging certain pharmaceuticals and many other products in an inexpensive and efficient manner.

Pursuant to FDA requirements, certain pharmaceuticals packaged in form-fill-seal packages are traditionally sterilized in a post-packaging autoclaving step. The post-packaging step includes placing the sealed package containing the pharmaceutical in an autoclave and steam sterilizing or heating the package and its contents to a required temperature, which is often approximately 250° F., for a prescribed period of time. This sterilization step operates to kill bacteria and other contaminants found inside the package, whether on the inner layer of film or within the pharmaceutical itself.

Certain packaged pharmaceuticals, including certain proteins such as albumin, however, generally cannot be sterilized in such a manner. This is because the heat required to kill the bacteria in the autoclaving process destroys or renders useless certain pharmaceuticals. Further, in the case of albumin protein, the heat may operate to congeal the protein.

Form-fill-seal packaging may also present other problems beyond sterilization concerns when packaging certain proteins such as albumin. Specifically, conventional form-fill-seal packaging machinery introduces heat to certain areas of the polymeric material of the package to create seals. If the heat contacts the protein during the sealing process, the protein may congeal or otherwise denature such as during high-temperature sterilization. Further, since certain proteins such as albumin, as well as other pharmaceuticals, operate as insulators, all seal areas must be free of the substance in order for the polymeric materials to be heat sealed together. If any substance, such as albumin is present in the seal area prior to sealing, the integrity of the seal may be jeopardized.

Thus, a convenient and cost-effective means for packaging certain proteins, including proteins such as albumin is desirable.

SUMMARY OF THE INVENTION

The present invention provides a flexible polymeric container for holding a concentration of a solution, including peptides and/or proteins. Such peptides and proteins include: glycoproteins, lipoproteins, imunoglobulins, monoclonal antibodies, enzymes, blood proteins, receptor proteins, and hormones. Additionally, the present invention provides a method of packaging such a solution in a flexible polymeric container. Generally, the flexible polymeric container comprises a sheet of flexible polymeric film formed into a bag. The bag has a cavity enclosed by a first wall and an opposing second wall. The bag further has seals about a periphery of the first and second walls that join an interior portion of the opposing first and second walls to create a fluid-tight chamber within the cavity of the container. A concentration of the solution is stored within the fluid-tight chamber. In one embodiment, the solution is albumin.

According to one aspect of the present invention, the flexible polymeric container for holding a concentrate of water-soluble albumin comprises a sheet of flexible polymeric material that is initially converted into a tube with a former, and is subsequently converted into a series of adjacent bags. The bags have a first side member, a second side member peripherally sealed to the first side member, and a cavity between an interior of the first and second side members. A quantity of a concentration of water-soluble albumin is located within the cavity of the bag. The openings of the bags are subsequently sealed to create a fluid-tight chamber.

According to another aspect of the present invention, the container has a plurality of peripheral edges. Three of the peripheral edges are sealed with heat, and one of the peripheral edges contains a fold that separates the first wall or first side member from the opposing second wall or second side member.

According to another aspect of the present invention, a fitment is connected to the container adjacent the fold. The fitment extends from the outer shell of the container at the fold and has a sealed passageway that cooperates with the fluid-tight chamber of the container. The sealed passageway extends into the cavity of the container to allow the albumin to be released from the fluid-tight chamber. A chevron may be located a distance from the opposing sides of the fitment, and along the fold, to assist drainage of the albumin from the container.

According to another aspect of the present invention, a heat seal block is provided to insulate the fitment heater from the filler assembly.

According to another aspect of the present invention, the peripheral edge of the container opposing the fold contains a first seal and a second seal. The first and second seals join the first and second opposing walls. An aperture is located between the first seal and the second seal, and extends through the first and second opposing walls.

According to another aspect of the present invention, the flexible polymeric sheet material comprises a laminate film having an outside layer of linear low density polyethylene, a gas barrier layer, a core layer of polyamide, and an inside layer of linear low density polyethylene. The layers are bonded together by a polyurethane adhesive.

According to another aspect of the present invention, albumin in concentrations of 20% and 25% is packaged in the flexible polymeric container. Additionally, the flexible polymeric containers may have a volume of 50 ml. or 100 ml.

According to another aspect of the present invention, a method of packaging albumin protein, as well as other solutions, comprises providing a flexible polymeric container having an opening extending from a cavity of the polymeric container, providing a quantity of a concentration of albumin, or other solution, typically a liquid-soluble solution, in a sterile solution, inserting the solution under a pressure into the cavity of the polymeric container through the opening, and sealing the opening to secure the liquid solution within a fluid-tight chamber of the cavity of the polymeric container.

According to another aspect of the present invention, a filler is used to insert the liquid solution into the flexible container. The filler has a distal tip with adjacent first and second interior passageways. The first interior passageway has a larger cross-sectional area than the second interior passageway. The second interior passageway extends adjacent the first interior passageway to an exterior of the tip, and the liquid solution is dispersed from the filler through the second interior passageway.

According to another aspect of the present invention, the interface between the first and second interior passageways is interior of an exterior of the tip, and the second interior passageway extends to the exterior of the tip. The liquid solution is maintained at the interface between the first and second interior passageways during a suspension of filling of the bags.

According to another aspect of the present invention, a sheath or other exterior member is located exterior to a portion of the filler adjacent the tip. The sheath prevents contact between the polymeric container and the filler.

According to another aspect of the present invention, the exterior member extends proximal the tip of the filler.

According to another aspect of the present invention, the sheath is concentric with the filler. An air passageway extends between an interior of the sheath and an exterior of the filler. Further, sterilized air passes through the air passageway and is expelled adjacent the tip of the filler and upstream of the liquid solution exit.

According to another aspect of the present invention, albumin is packaged in a series of flexible polymeric containers with a form-fill-seal packaging machine. A quantity of filtered albumin and a flexible polymeric material is provided, and the form-fill-seal packaging machine converts the flexible polymeric material into a series of bags. The bags are filled with a quantity of albumin within the form-fill-seal packaging machine, and a seal area of the bags is sealed with the packaging machine to enclose the quantity of the albumin in the bags.

According to another aspect of the present invention, the adjacent bags in the series of bags are initially connected, are sequentially filled with a quantity of albumin, and are separated following the filling of each bag.

According to another aspect of the present invention, the form-fill-seal packaging machine has an aseptic area. The sterilized flexible polymeric material is provided within the aseptic area, and is formed into bags within the aseptic area. Additionally, the liquid solution is inserted into the bags in the aseptic area, and the bags are sealed within the aseptic area to form a fluid-tight container.

According to another aspect of the present invention, albumin is packaged in a series of flexible polymeric containers in a form-fill-seal packaging machine with the following process: converting flexible polymeric material into a tube with a former in the form-fill-seal packaging machine; converting the tube into a series of bags in the form-fill-seal packaging machine; sequentially filling the bags with a quantity of albumin within the form-fill-seal packaging machine; and, sealing a seal area of the bags with the packaging machine to enclose the quantity of the albumin within the bags. The bags may be filled with a filler that discharges albumin from the filler and into the bag without contacting the seal area of the opening of the bag.

According to yet another aspect of the present invention, albumin is packaged in a flexible polymeric container with the following process: providing a concentrate of albumin; providing a packaging machine having a forming assembly, a filling assembly, and a sealing assembly, each of which is located within an interior aseptic environment of the packaging machine; providing a flexible polymeric film; forming the flexible polymeric film into an elongated tube with the forming assembly; sealing a portion of the elongated tube of polymeric film with the sealing assembly, the sealed polymeric film being dimensioned in the shape of a bag having seal areas about a periphery thereof, a cavity located within the bag and between the seal areas, and an opening extending from the cavity to an exterior of the bag; filling the bag with albumin under pressure through the filling assembly, the filling assembly having a fill tube extending through the opening of the bag and into the cavity of the bag, and a sheath concentric to an exterior of the fill tube, the fill tube directing the albumin into an interior of the bag a distance away from a periphery of the opening of the bag, and the sheath limiting contact between the fill tube and the bag; and, sealing the opening of the bag to retain the albumin within the cavity of the bag.

Accordingly, a flexible polymeric container for storing albumin made in accordance with the present invention provides an inexpensive, easily manufactured, and efficient package and process which eliminates the drawbacks associated with prior packages and processes for packaging albumin.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 2 is a schematic view of the process for manufacturing the flexible polymeric container holding a concentration of albumin of the present invention;

FIG. 3 is a front elevation view of the flexible polymeric container holding a concentration of albumin of the present invention;

FIG. 4 is a partial side elevation view of the flexible polymeric container holding a concentration of albumin of FIG. 3;

DETAILED DESCRIPTION OF THE PREFERRED EMBODIMENT

Figure 1:
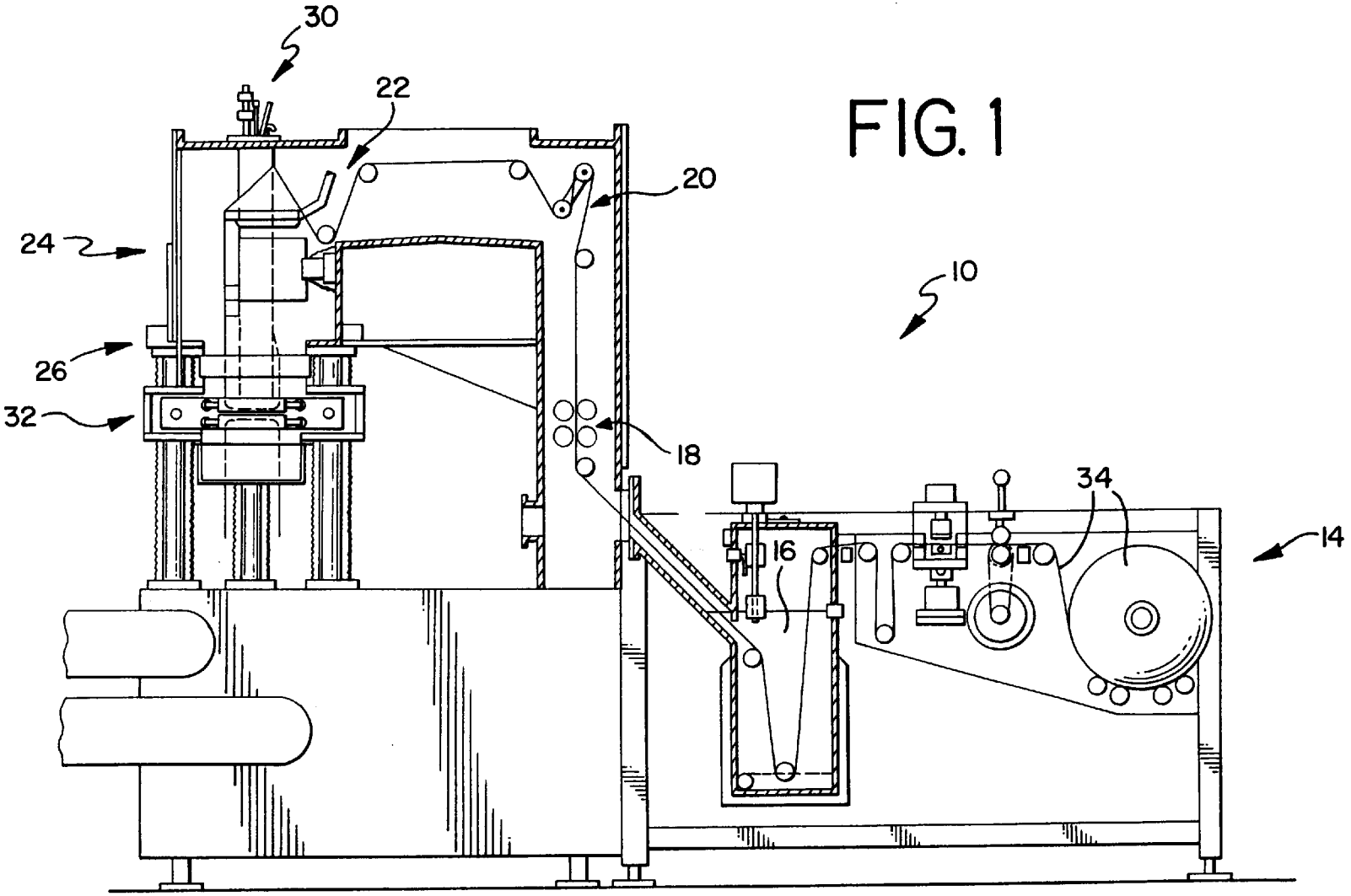
FIG. 1 is a cross-sectional elevation view of a form-fill-seal packaging machine for manufacturing a flexible polymeric container holding a concentration of albumin of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

As identified above, the breadth of the present disclosure includes the packaging of any type of certain pharmaceutical compounds such as peptides and proteins for pharmaceutical or other use. Such compounds are known and include: glycoproteins, lipoproteins, imunoglobulins, monoclonal antibodies, enzymes, blood proteins, receptor proteins, and hormones. For purposes of example, however, the detailed description of the present invention focuses on the packaging of albumin in a flexible polymeric container.

Referring now in detail to the FIG. 3, there is shown a flexible polymeric container 12 of the present invention holding a concentration of albumin. The flexible polymeric container 12 is preferably manufactured by an aseptic form-fill-seal packaging machine 10 as shown in FIG. 1, and utilizing the process schematically illustrated in FIG. 2.

The aseptic form-fill-seal packaging machine 10 generally includes an unwind section 14, a film sterilizing section 16, a film drying section 18, an idler roller/dancer roller section 20, a nipped drive roller assembly section (not shown), a forming assembly section 22, a fin seal assembly section 24, a fitment attaching assembly section 26, a filling assembly section 30, an end sealing/cutting assembly section 32, and a delivery section (not shown). Each of these assemblies downstream of the unwind section 14 is contained within the internal aseptic environment of the aseptic form-fill-seal packaging machine 10.

One of the functions of each of the various assemblies of the form-fill-seal packaging machine 10 is as such: the unwind section 14 contains a roll of the flexible polymeric film 34 that is ultimately formed into the container; the film sterilizing section 16 provides a peroxide bath to sterilize the film 34; the film drying section 18 provides a means for drying and cleaning the peroxide from the film 34; the forming assembly 22 provides a forming mandrel 36 to convert the web of film into a tube 38 that ultimately becomes the flexible container or bag 12; the fin seal assembly 24 provides the longitudinal seal 40 on the tube 38 that ultimately becomes the longitudinal seal 40 on the flexible container 12, thereby longitudinally sealing the formed tube 38; the fitment attachment assembly 26 attaches a fitment 42 to the tube 38; the filling assembly 30 includes a filler 44 that fills the flexible containers 12 with a substance, that being a concentration of water-soluble albumin in the preferred application; and, the end sealing/cutting assembly 32 contains sealing and cutting jaws 46 that form the end seals 76,78 of the flexible polymeric containers 12 to enclose the albumin within the flexible polymeric container 12, and ultimately separate the formed, filled and sealed containers 12.

In the preferred embodiment, the albumin utilized to be packaged in the flexible polymeric container 12 is either a 20% human albumin or a 25% human albumin. Those skilled in the art will understand that any concentration of albumin is operable under this description. To achieve the required concentration level, the albumin is typically combined with sterile water and stabilizers. Further, prior to packaging the albumin concentration is pasteurized and stored in large stainless steel holding tanks (not shown) having a volumetric capacity of approximately 500–600 liters, at approximately 2° C. to 8° C. Immediately before packaging, the albumin tanks are removed from refrigeration and allowed to equilibrate to the packaging room temperature (approximately 68° F.). One should process albumin at temperatures which do not result in denaturing of the protein, approximately below 60° C. However, anywhere between 0° C. and 60° C., and more preferably between 20° C. and 45° C. is appropriate. Additionally, in one embodiment the process temperatures 68° F. to 77° F. Additionally, the albumin is filtered through a 0.2 micron filter as it enters the packaging machine 10.

Figure 9:
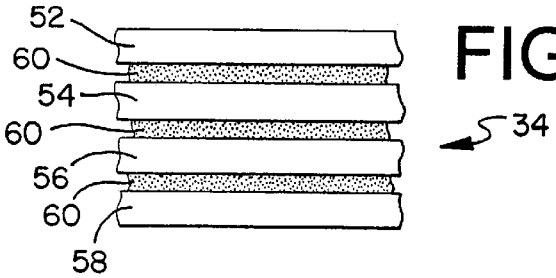
FIG. 9 is a schematic cross-sectional view of an embodiment of the film laminate structure of the present invention.

The flexible polymeric film 34 utilized in the preferred embodiment of the present invention is a linear low density polyethylene laminate. It has been found that such a film with a gas barrier is particularly suitable for housing oxygen labile solutions, such as the identified proteins, including albumin. Specifically, it has been found that this film reduces or eliminates the denaturing process previously associated with placing proteins, such as albumin, in a plastic container. As shown in FIG. 9, in the preferred embodiment the laminate film 34 has an outside layer of linear low density polyethylene (LLDPE) 52, a gas barrier layer 54, a core layer of polyamide 56, and an inside layer of linear low density polyethylene 58, the layers being bonded together by a polyurethane adhesive 60. Most preferably, the material requirements of the laminate structure has the following characteristics: a LLDPE layer (approximately 61±10 $\mu$m) 52, a polyurethane adhesive layer 60, a polyvinylidene chloride (PVDC) layer (approximately 19±5 $\mu$m) 54, a polyurethane adhesive layer 60, a nylon layer (approximately 15±5 μm) 56, a polyurethane adhesive layer 60, and LLDPE layer (approximately 61±10 μm) 58. In total, the thickness of the film is approximately 160±25 μm. Additionally, the PVDC layer 54 is most preferably manufactured by Dow Chemical and sold under the trademark SARAN. Such a film is disclosed in U.S. Pat. No. 4,629,361. U.S. Pat. No. 4,629,361 is assigned to the assignee of the present invention, and is incorporated herein, and made a part hereof, by this reference. This film 34 is manufactured by Fujimori under the trade name FTR-13F.

Prior to usage, the internal aseptic area of the packaging machine must be sterilized each day. This is accomplished with a hydrogen peroxide fog which is passed through the aseptic area of the packaging machine.

As seen in FIG. 1, the roll of film 34 is located in the unwind section 14 of the packaging machine 10. During use, the film 34 is transferred through a hydrogen peroxide bath 16 to sterilize the film before entering the aseptic area of the packaging machine 10. This sterilization step cleans the web of film so that it can be utilized to create a sterile product. Sterilization and cleansing of the film is critical in the medical industry when one is packaging parenternal or enteral products. This sterilization step is especially critical when the resultant product is not to be terminally sterilized, i.e., when the packaging machine is an aseptic packaging machine. After the film has been washed, cleaned or sterilized, liquid and other residue, for example the chemical sterilant or wetting agent such as the hydrogen peroxide typically remains on the film. Thus, it is necessary to remove the liquid and/or residue from the film 34. An air knife (a stream of air blown across the web of film so that the liquid contained thereon is blown off the film) located in the film drying section 18 is utilized to remove liquid and other residue from the film 34 as the film enters the aseptic area of the packaging machine.

In the aseptic area of the packaging machine 10, the film 34 passes through the dancer roller section 20 and the drive roller section prior to entering the forming assembly section 22. Before entering the forming assembly 22 the web of film 34 is substantially planar, and has a first surface 62 and a second surface 64. The first surface 62 faces downward as the film enters the forming assembly 22 and ultimately becomes an interior of the container 12, while the second surface 64 faces upward as the film enters the forming assembly 22 and ultimately becomes the outside of the container 12.

As shown in FIGS. 3 and 4, the film 34 additionally has a theoretical fold-line approximately located about a centerline of the length of the web of film 34. The theoretical fold-line becomes a fold area 67 that separates the first side member 66 or first wall from the second side member 68 or second wall of the container 12.

A forming mandrel 36 is located in the forming assembly section 22. The forming mandrel 36 assists in converting the substantially planar web of polymeric material 34 into an elongated and substantially tubular member 38. It is understood that the elongated tubular member 38, or tube, is generally not cylindrical, but rather has an oblong shape as shown in FIG. 4. In connection with the identification of the areas of the web of film as described above, after the film 34 traverses through the forming assembly 22, the first surface 62 of the first side member 66 opposes the first surface 62 of the second side member 68.

Figure 11:
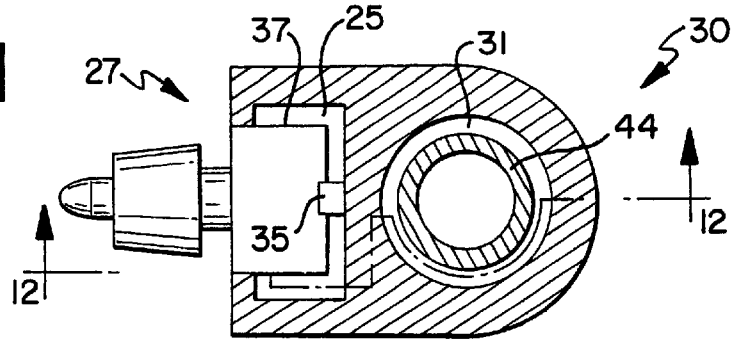
FIG. 11 is a partial top cross-sectional view about lines 11—11 of FIG. 12 of the fill tube and fitment assembly of the form-fill-seal packaging machine of the present invention; and, FIG. 12 is a partial side cross-sectional view about lines 12—12 of FIG. 11 of the fill tube and fitment assembly of the present invention.
Figure 12:
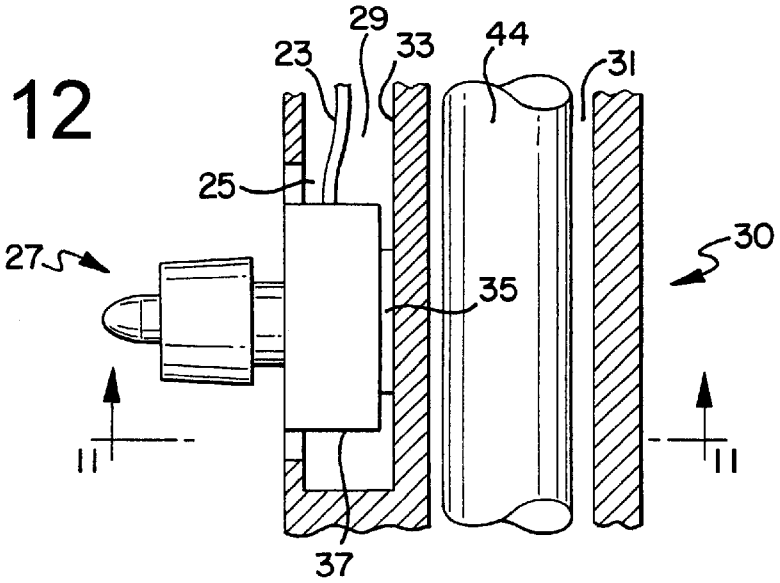

Once the tubular member 38 is formed, the tubular member receives a longitudinal seal 40 in the fin seal assembly section 24, and a fitment 42 is connected to the tube 38 with the fitment attachment assembly 26. The fitment 42 is attached to and extends from the outer shell of the container 12 at the fold area 67 with the use of a fitment sealer 27 that seals the fitment 42 to the fold area 67 of the container 12. One component of the fitment sealer 27 is the heat seal block 37. As shown in FIGS. 11 and 12, the heat seal block 37 is located in a pocket 25 in the filler assembly 30 (sometimes the filler assembly 30 is referred to as the heat tube). Additionally, a first channel 29 connects the pocket 25 with a top of the filler assembly 30 to allow for wires 23 and other components to traverse down to the heat seal block 37 and other components in the filler assembly 30. A second channel 31 is adjacent the first channel 29. The filler 44 is located in the second channel 31 of the filling assembly 30. The fitment sealer 27 operates at a temperature from about 415° F. to about 450° F., and with a pressure from about 55 psig to about 70 psig, although one of ordinary skill in the art would understand that any range within the above-identified ranges is acceptable.

Because of the intense operating temperatures of the fitment sealer 27, and specifically the heat seal block 37, the fitment sealer 27 should be insulated from the albumin (as well as any other protein, drug or other components wherein heat will have an impact thereon) flowing through the filler 44 in the adjacent second channel 31 of the filling assembly 30. It has been determined that insulating the fitment sealer 27 from the albumin flowing through the filler 44 should decrease the likelihood of heat migrating to the filler 44 and causing congealing of the albumin in the filler 44.

One means for insulating the fitment sealer 27, and specifically the heat seal block 37 within the first channel 29 of the filler assembly 30 is with an insulator means. In the preferred embodiment, an insulator is provided for insulating the heat of the fitment sealer 27 from the rest of the filling assembly 30. To accomplish this, the heat seal block 37 is initially located a distance from the wall 33 of the pocket 25 in the filler assembly 30. And, an insulating spacer 35 is positioned between the fitment sealer 27 and the wall 33 to maintain a minimum distance. In the preferred embodiment, the insulating spacer 35 is made of a Vespel SP2 material available from Dupont. The insulating spacer 35 is in the shape of a mechanical key, and fits in a mating key slot (not shown) in the heat seal block 37. The insulating spacer extends beyond the heat seal block 37 by preferably at least 1/16".

Additionally, in one embodiment the heat seal block 37 for the fitment sealer 27 is made of an anodized aluminum that is coated with an insulating ceramic. More specifically, the heat seal block 37 is coated with a 0.008"–0.012" thick plasma spray ceramic to provide a thermal barrier. In this embodiment, the plasma spray ceramic is applied to the aluminum heat seal block 37 after it has been fabricated, assembled and hard-coat anodized. Those skilled in the art will recognize that the insulator for the heat seal block 37 may actually be any insulating material or insulating member. Additionally, the insulating member may be a separate component from the heat seal block 37 that may be placed between the heat seal block 37 and the filler assembly 30. In another embodiment, the insulator means is located in the pocket 25 of the filler assembly 30. In this embodiment, the insulator means may be either a separate insulating component located within the pocket 25, or it may be an insulating component that is coated on the wall of the pocket 25 to insulate the filler assembly 30 from the heat of the fitment sealer 27.

As shown in FIG. 4, the fitment 42 has a sealed passageway that cooperates with the interior of the tube 38. The passageway extends into and creates a fluid communication with the cavity 82 of the container to allow the albumin to be released from the fluid-tight chamber. One of ordinary skill in the art would fully understand that in some embodiments the albumin may be injected into the cavity 82 of the container 12 through the fitment 42.

The fin seal assembly 24 introduces heat and pressure to the film 34 to create the longitudinal seal 40 at the peripheral edge of the tube 38 that opposes the fold area 67. Typically, the fin seal assembly operates at a temperature from about 350° F. to about 380° F., and with a pressure from about 40 psig to about 80 psig, although any range within these identified ranges is acceptable. In the preferred embodiment of the container 12 as shown in FIG. 3, the longitudinal seal 40 comprises a first longitudinal seal 70 and a second longitudinal seal 72. Those skilled in the art will recognize that while the preferred embodiment comprises first and second longitudinal seals 70,72, a variety of seal types, quantities and sizes may actually be utilized without departing from the scope of the present invention. The first and second longitudinal seals 70,72 join the first surface 62 of the first wall 66 to the opposing first surface 62 of the second wall 68. An aperture 74, typically utilized to hang a formed container 12, is created between the first longitudinal seal 70 and the second longitudinal seal 72. Accordingly, the aperture 74 extends through the first and second opposing walls 66,68.

The sealed tubular member 38 traverses from the fin seal assembly 24 to the filling assembly 30 and the end sealing assembly 32. At the end sealing assembly 32, the form-fill-seal packaging machine 10 utilizes heat and pressure to convert the sealed tube 38 into a series of bags 12, also referred to as containers 12. Typically, the end sealing assembly operates at a temperature from about 375° F. to about 405° F., and with a pressure from about 500 psig to about 850 psig, although any range within these identified ranges is acceptable. The sealed tube 38 first receives a bottom seal 76 to initially form the bag 12 having a cavity 82 located between the first and second sides 66,68 of the container 12 and the bottom seal 76 of the container, and an opening 80 that extends from the cavity 82 of the container 12 to an exterior of the container 12. It should be understood that during the form-fill-seal manufacturing process, the opening 80 extends from the cavity 82 of the container 12 into the center of the tube 38. Once the bottom seal 76 is created, the bag 12 is filled with the albumin through the opening 80, and then the top seal 78 is formed, thus sealing or closing the opening 80 and creating a fluid-tight chamber 82 wherein the albumin is retained. Further, once the bottom seal 76 is created, the polymeric film 34 can be said to be dimensioned in the shape of the open bag 12, having seal areas about its periphery (the longitudinal seal 34 opposing the fold area 67, and the bottom seal 76 joining the fold area 67 and the longitudinal seal 40), and having a cavity 82 located within the bag 12 and between the seal areas 40, 76 and the fold area 67. Thus, with the preferred embodiment of the form-fill-seal packaging process, the finished container 12 has sealed areas on three sides of the bag 12: the top seal 78, the bottom seal 76, and the longitudinal seal 40. The longitudinal seal 40 joins the top seal 78 and the bottom seal 76. In the preferred process, the top seal 78 of a first bag 12 is formed at the same time as the bottom seal 76 of an adjacent upstream bag 12 with the end sealing assembly 32. As such, adjacent bags 12 in the series of bags 12 are initially connected, both by being part of the tubular member 38 that forms the bags 12, as well as by having end seals that are formed with the same end sealing assembly 32.

In the preferred embodiment of the process for creating and filling containers of present invention with albumin as illustrated in FIGS. 1 and 2, the containers 12 are filled with the albumin through a filling assembly 30 that extends down the tube 38. The filling assembly 30 thus operates to fill the cavity 82 of the bag 12 through the opening 80 of the in-process, three-sided and open bag 12. It will be understood that the apparatus and process for creating and filling bags of the present invention is not to be limited to filling containers with albumin or other proteins or peptides. Additionally, it is understood that the breadth of the apparatus and process for creating and filling bags of the present invention, including certain aspects of the apparatus and process for creating and filling bags of the present invention is not limited to creating and filling containers with albumin or other proteins or peptides. Other solutions, including other drug solutions are suitable for use with the present invention. For example, with respect to the heater block, one of ordinary skill in the art would understood that such an aspect of the present invention can be utilized with any filler solution wherein heat may have an adverse impact thereon. As a further example, with respect to the filling assembly, one of ordinary skill in the art would understand that such an aspect of the present invention can be utilized with any filler solution wherein the existence of such solution in a seal area may adversely effect the integrity of the seal area. Further, one of ordinary skill in the art will understand that the broad application of the apparatus and process described herein is not limited to the above examples.

The filling assembly 30 of the preferred embodiment is illustrated in FIGS. 5–8 and 10. As such, the filling assembly 30 comprises a pressurized filler 44 made up of a fill tube 84, and a sheath 86 located concentrically about the perimeter of the fill tube 84. For filling albumin, the filler 44 typically operates under a solution line pressure of from about 4 psig. to about 20 psig, however, any range of pressures within the identified range is acceptable. Additionally, as one of ordinary skill in the art would understand, the filling pressure range may vary depending on the solution being filled. In the preferred embodiment, the filler for the albumin operates under a solution line pressure of from about 10 psig. to about 16 psig, and most preferably under a solution line pressure of from about 12 psig. to about 16 psig. The identified ranges are utilized in an attempt to reduce turbulence and splashing of the albumin or other protein as it is inserted into the container 12. As explained above, after the bottom seal 76 is created, the bag 12 is filled with the albumin through the filling assembly 30, the top seal 78 is created simultaneously with the bottom seal 76 of the next bag, the next bag 12 of the tube 38 is sequentially filled, and so on and so forth. Thus, adjacent bags 12 in the series of bags 12 are initially connected, and are then separated following sequentially filling and sealing of each respective bag 12.

Figure 5:
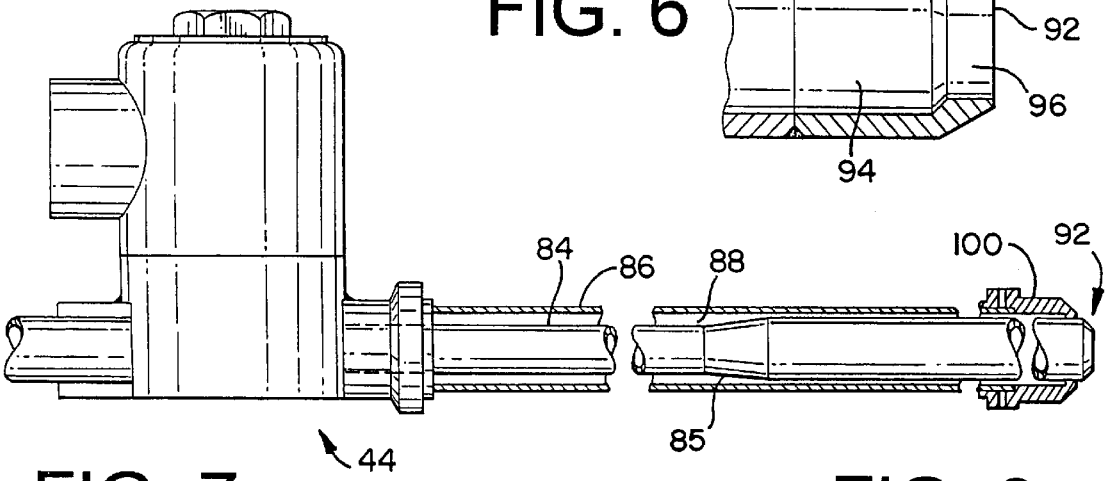
FIG. 5 is a side elevation view of a partial filler assembly of the present invention.

As shown in FIG. 5, in the preferred embodiment, the filler 44 of the filling assembly 30 is configured as a tube 86 over a tube 84. Additionally, as shown in FIGS. 11 and 12, the filler 44 traverses within the second channel 31 of the filling assembly 30. The sheath tube 86 is situated concentric about the fill tube 84, with an air passageway 88 extending in the space between the inner diameter of the sheath tube 86 and the outer diameter of the fill tube 84. Sterilized air passes through the air passageway and is expelled adjacent a tip of the fill tube 84, upstream of a fill tube exit 92.

Figure 6:
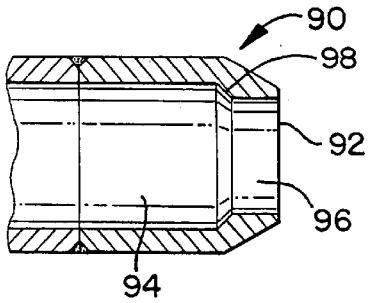
FIG. 6 is an enlarged side elevation view of a portion of the filler assembly of FIG. 5.

In a preferred embodiment of the fill tube 84 as shown in FIG. 5, the fill tube 84 has a venturi 85 that tapers from a first diameter to a second larger diameter about its length. Further, as shown in FIG. 6, the tip 90 of the fill tube 84 has a first interior passageway 94 concentric with and adjacent a second interior passageway 96. And, in a preferred embodiment of the present invention, the first interior passageway 94 is generally circular in cross-sectional shape, having a first interior diameter, and the second interior passageway 96 is generally circular in cross-sectional shape, having a second interior diameter. The interior diameter, and thus the cross-sectional area, of the first interior passageway 94 is dimensioned larger than the interior diameter, and thus the cross-sectional area, of the second interior passageway 96. An interface 98 connects the first interior passageway 94 and the second interior passageway 96 at a location that is interior of an exterior of exit 92 of the tip 90 of the filler 44. In a preferred embodiment, the interface comprises a chamfered step 98 between the first and second interior passageways 94,96 to sharply reduce the diameter from the first interior passageway 94 to the second interior passageway 96. The interface 98 between the first and second passageways 94,96 provides a useful function in the operation of the filler. Since the albumin, or any other solution, is dispensed from the exit of the second interior passageway 96 of the filler 44, capillary forces in the fill tube operate to have the meniscus of the albumin reside at the interface 98 between the first and second passageways 94,96 during a stoppage in filling instead of at the exit 92 of the second passageway. Thus, even though the albumin is dispersed from the filler 44 through the second interior passageway 96, during each suspension in filling in between sequential filling of the bags 12, the albumin is maintained interior to and a distance from the exit of the filler 44, and at the interface 98 of the first and second passageways 94,96. Such a configuration greatly assists in preventing migration of the albumin from the exit of the filler. Any migration may allow the albumin to be transferred onto an exterior of the filler and contact the film 34. As explained above, some solutions, including albumin, operate as an insulator. If the albumin migrated onto the film it would likely jeopardize the integrity of the top seal area. Thus, the configuration of the present invention provides a means for eliminating this drawback. In testing conducted on the seal integrity of the containers 12 of the present invention, 99.90% of the formed containers 12 were above the minimum seal strength value of 20 psi in burst test evaluation.

Figure 10:
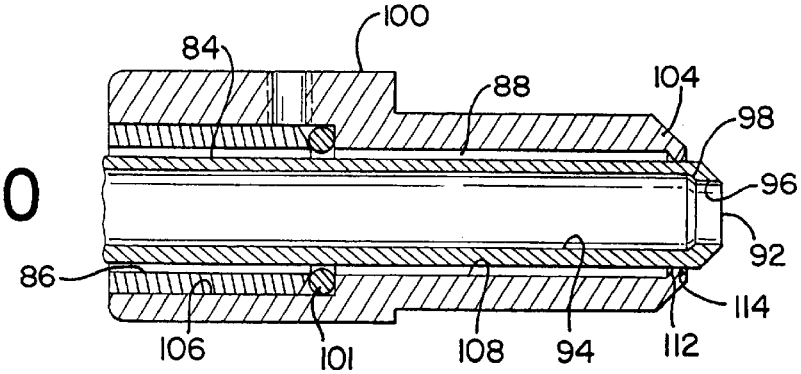
FIG. 10 is a cross-sectional view of the end of the fill tube and sheath of the present invention.

As explained above, in the preferred embodiment the sheath 86 resides concentrically about a perimeter of the fill tube 84, and an air passageway 88 extends in the space between the inner diameter of the sheath tube 86 and the outer diameter of the fill tube 84. While in the preferred embodiment the distal end portion 100 of the sheath 86 is an adapter that is mounted on the sheath 86, the distal end portion 100 may be manufactured as part of the sheath 86 without destroying the intended function of the sheath 86. As shown in FIG. 10, when an adapter 100 is utilized, an O-ring 101 provides a seal between the sheath 86 and the adapter 100.

Figure 7:
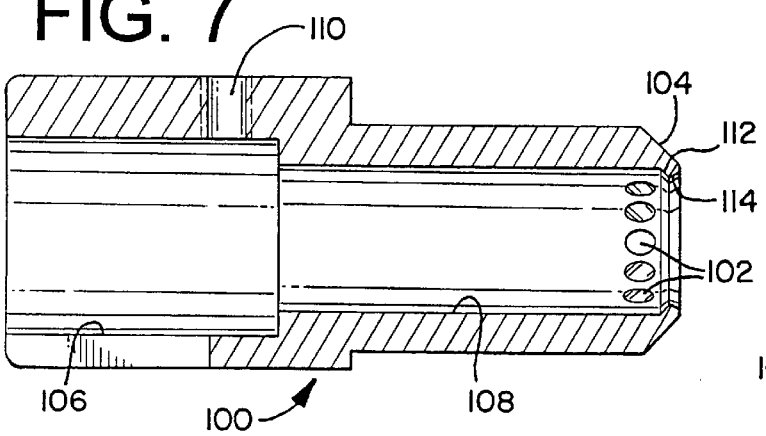
FIG. 7 is a cross-sectional side elevation view of a sheath for the filler assembly of the present invention.
Figure 8:
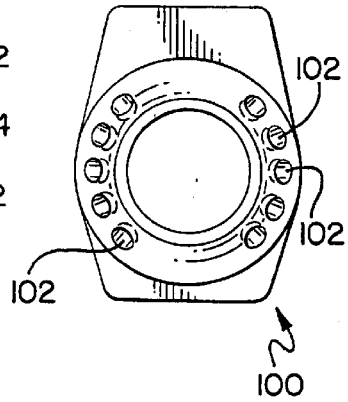
FIG. 8 is an end elevation view of the sheath of FIG. 7.

As shown in FIGS. 7 and 8, the distal end portion 100 of the sheath 86 has a chamfered end 104. A plurality of vent holes 102 are located adjacent the end of the distal end portion 100 of the sheath 86. The sterilized air is dispelled from the air passageway 88 out of the vent holes 102. Since the exit of the vent holes 102 resides at the chamfered end 104 of the sheath 86, the flow pattern of the sterilized air is circumferentially exterior to the flow pattern of the albumin being dispelled from the fill tip so as not to interfere with the flow of the albumin. This decreases the chances of the sterilized air from introducing a turbulent effect to the dispensed albumin. Additionally, since the air flow pattern is exterior to and away from the liquid flow pattern of the albumin, any possible foaming of the albumin that may come in contact with the air is minimized. Similar to the benefits uncovered with the dual inner diameters of the fill tube 84, the benefits uncovered with the flow of the sterilized air are extremely useful. Such a configuration greatly assists in preventing splashing and foaming of the albumin from the exit of the filler. Furthermore, angling the air flow pattern exterior to and away from the fill tube assists in pushing the film away from the exit of the fill tube, and thus away from the albumin. Each of these assist in preventing contact by the albumin with the portion of the film that is converted into the top seal area, thereby also aiding in continually creating a stronger top seal.

As shown in FIG. 10, the first interior diameter 106 of the distal end portion 100 is dimensioned to fit onto the sheath 86 and be secured thereto with a setscrew 110 when an adaptor is utilized. In such a configuration, the o-ring 101 is placed between the sheath 86 and the first interior diameter 106 of the distal end portion 100 to maintain a proper seal. The second interior diameter 108 of the distal end portion 100 is dimensioned to provide the air passageway 88 between the sheath 86 and the fill tube 84. As shown in FIG. 7, a chamfer 112 is located at the end of the second interior diameter 108 to further reduce the inside diameter of the sheath 86. A reverse chamfer 114 is located at an exterior portion of the end of the sheath 86.

The sheath 86 and fill tube 84 are shown as assembled in FIG. 10. As seen in the illustration, the outside diameter of the fill tube 84 is dimensioned to be the same as or slightly less than the reduced inside diameter of the sheath 86 at the chamfer 112. In the preferred embodiment, the second interior diameter of the sheath 86 is approximately 0.584 inch, and is decreased at the chamfer 112 to approximately 0.500 inch. Additionally, the outside diameter of the fill tube 84 of the preferred embodiment of the present invention is approximately 0.500 inch. As such, interface between the chamfer 112 and the fill tube 86 operates to close the air passageway 88 and force the sterilized air out the vent holes 102 located upstream of the exit 92 of the second interior passageway of albumin fill tube 84.

Also, as seen in FIG. 10, the outside diameter of the sheath 86 is larger than the outside diameter of the fill tube 84 protruding past the sheath 86. Often during filling the tube 38 of film contacts the filling assembly 30. With the identified configuration of the fill tube and sheath, even though during a portion of the filling process the fill tube 84 of the filling assembly 30 extends through the opening 80 of the bag and into the cavity 82 of the bag, the sheath 86 is exterior to a portion of the fill tube 84, and thus only the sheath 86 can contact the tube 38, thereby preventing contact between the polymeric container and the fill tube 84. As such, the exit 92 of the fill tube 84 is positioned a distance away from the interior wall of the flexible polymeric container 12. Thus, the position and size of the sheath 86 in combination with the interior interface 98 of the first and second interior passageways, and the reverse chamfer 114 prevents any albumin from migrating to an exterior of the filling assembly 30 and coming in contact with the seal areas of the tube 38 that ultimately become the top seal 78 of the finished container. Since albumin operates as an insulator, it is necessary to maintain all seal areas free of the protein in order for the polymeric materials to be heat sealed together. If any albumin was present in the seal area prior to sealing, the integrity of the seal may be jeopardized. As such, with the identified configuration, the albumin is discharged from the fill tube 84 and into the bottom of the bag 12 without contacting the seal area of the opening of the bag 12 that ultimately becomes the top seal 78. Note, however, that not all of the above-identified precautions are required in order to practice the invention.

Figure 10A:
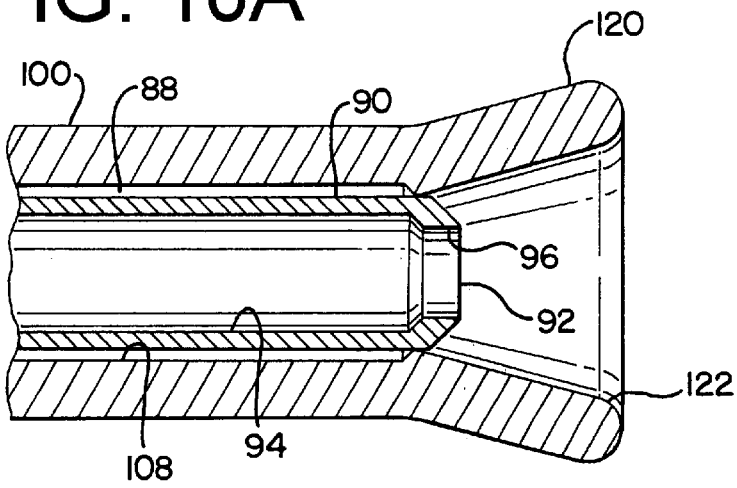
FIG. 10A is a cross-sectional view of the end of another embodiment of the fill tube and sheath of the present invention.

FIG. 10A discloses another embodiment of the filler 44 of the present invention. In this embodiment the distal end portion 100 of the sheath 86 has a portion thereof 120 that extends proximal the exit 92 of the tip 90. Additionally, the distal end portion 100 of the sheath 86 may have fingers 122 that extend proximal or beyond the exit 92 of the tip 90. The end portion 100 that extends past the distal end portion 100 of the sheath may also extend away from or transverse to the fill tube 84. As such, the film contacts the extending portions 120. In this configuration, there is a greater likelihood of preventing contact between the polymeric container and the fill tube 84, and more importantly, a greater likelihood that the solution will not come in contact with the seal areas of the tube 38.

While the specific embodiments have been illustrated and described, numerous modifications come to mind without significantly departing from the spirit of the invention, and the scope of protection is only limited by the scope of the accompanying claims.

We claim:

1. A method of packaging albumin protein, comprising the steps of:

providing a flexible polymeric container having an opening extending from a cavity of the polymeric container;

providing a quantity of a concentration of albumin in a sterile solution;

inserting the albumin under a solution line pressure from about 4 psig. to about 20 psig. into the cavity of the polymeric container through the opening therein; and, sealing the opening to secure the liquid albumin within a fluid-tight chamber of the cavity of the polymeric container.

2. The method of claim 1, wherein the albumin is maintained at a temperature of about 68° F. prior to insertion into the cavity of the container.

3. The method of claim 1, wherein the albumin is inserted into the cavity of the flexible polymeric container under a solution line pressure from about 12 psig. to about 16 psig.

4. The method of claim 1, wherein the flexible polymeric container is provided within an aseptic environment of a form-fill-seal packaging machine, wherein the albumin is inserted into the cavity of the flexible polymeric container within the aseptic environment of the form-fill-seal packaging machine, and wherein the opening of the container is sealed within the aseptic environment of the form-fill-seal packaging machine.

5. The method of claim 1, further comprising the step of providing a filler having a distal tip with first and second adjacent interior passageways, the first interior passageway having a larger cross-sectional area than the second interior passageway, wherein the second interior passageway extending adjacent the first interior passageway to an exterior of the tip, and wherein the albumin is dispersed from the filler through the second interior passageway.

6. The method of claim 1, further comprising the step of providing a filler having a tip with concentric first and second interior passageways, the first interior passageway having an inside diameter being dimensioned larger than an inside diameter of the second interior passageway, wherein an interface between the first and second interior passageways is interior of an exterior of the tip, wherein the second interior passageway extends to the exterior of the tip, and wherein the albumin exits the filler through the second interior passageway.

7. The method of claim 6, further comprising the step of providing a sheath exterior a portion adjacent the tip of the filler, the sheath preventing contact between the polymeric container and the filler.

8. The method of claim 1, wherein the albumin is provided in a 20% concentration.

9. The method of claim 1, wherein the albumin is provided in a 25% concentration.

10. The method of claim 1, wherein the flexible plastic container is provided having a volume of 50 ml.

11. The method of claim 1, wherein the flexible plastic container is provided having a volume of 100 ml.

12. The method of claim 1, wherein the flexible polymeric container comprises a laminate film having an outside layer of linear low density polyethylene, a gas barrier layer, a core layer of polyamide, and an inside layer of linear low density polyethylene, the layers being bonded together by a polyurethane adhesive.

13. A method of packaging albumin protein in a series of flexible polymeric containers, comprising the steps of:

providing a quantity of filtered albumin;

providing a flexible polymeric material;

providing a form-fill-seal packaging machine and converting the flexible polymeric material into a series of bags in the form-fill-seal packaging machine;

filling the bags with a quantity of albumin within the form-fill-seal packaging machine; and, sealing a seal area of the bags with the packaging machine to enclose the quantity of the albumin within the bags.

14. The method of claim 13, wherein adjacent bags in the series of bags are initially connected, and are separated following the filling of each bag.

15. The method of claim 14, further comprising providing a forming mandrel in the form-fill-seal packaging machine.

16. The method of claim 15, further comprising forming the flexible polymeric material into a tube with the forming mandrel, and further forming the tube into the series of adjacent bags.

17. The method of claim 13, wherein the bags are sequentially filled with the quantity of albumin.

18. The method of claim 13, further comprising heat sealing a periphery of the bags to enclose the quantity of the albumin within the bags.

19. The method of claim 13, wherein the flexible polymeric container comprises a laminate film having an outside layer of linear low density polyethylene, a gas barrier layer, a core layer of polyamide, and an inside layer of linear low density polyethylene, the layers being bonded together by a polyurethane adhesive.

20. The method of claim 13, wherein the form-fill-seal packaging machine has an aseptic area, wherein the flexible polymeric material is sterilized, wherein the sterilized flexible polymeric material is formed into a series of adjacent bags within the aseptic area, wherein the albumin is sequentially inserted into the bags in the aseptic area, and wherein the bags are sequentially sealed within the aseptic area to form a fluid-tight container.

21. The method of claim 13, further comprising the step of providing a repeating filler having a tip with concentric first and second interior passageways, the first interior passageway having a cross-sectional area greater than a cross-sectional area of the second interior passageway, wherein an interface between the first and second interior passageways is interior of an exterior of the tip, wherein the second interior passageway extends to the exterior of the tip, wherein the albumin exits the filler through the second interior passageway, and wherein the albumin is maintained at the interface between the first and second interior passageways during a suspension of filling.

22. The method of claim 21, further comprising the step of providing a sheath exterior to a portion adjacent the tip of the filler, the sheath limiting contact between the polymeric container and the filler.

23. The method of claim 21, further comprising the step of providing an exterior sheath concentric with the filler, and an air passageway extending between an interior of the sheath and an exterior of the filler, wherein the sheath limits contact between the polymeric container and the filler, and wherein sterilized air passes through the air passageway and is expelled adjacent the tip of the filler and upstream of the albumin exit.

24. The method of claim 13, further comprising the step of filtering the albumin through a 0.2 micron filter.

25. A method of packaging albumin protein in a series of flexible polymeric containers, comprising the steps of:

providing a quantity of filtered albumin;

providing a flexible polymeric material;

providing a form-fill-seal packaging machine and converting the flexible polymeric material into a tube with a former in the form-fill-seal packaging machine;

converting the tube into a series of bags in the form-fill-seal packaging machine;

filling the bags, through an opening in the bags, with a quantity of albumin within the form-fill-seal packaging machine; and, sealing a seal area of the opening of the bags with the packaging machine to enclose the quantity of the albumin within the bags.

26. The method of claim 25, wherein the bags are sequentially filled with the quantity of albumin.

27. The method of claim 25, further comprising a filler discharging albumin from the filler and into the bag without contacting the seal area of the opening of the bag.

28. A process of packaging albumin in a flexible polymeric container, comprising the steps of:

providing a concentrate of albumin;

providing a packaging machine having a filling assembly and a sealing assembly, the filling and sealing assemblies being located within an interior aseptic environment of the packaging machine;

providing a sterile flexible polymeric container having an opening extending into a cavity;

filling the container with albumin under pressure through the filling assembly within the aseptic area of the packaging machine, the filling assembly having a fill tube exit positioned a distance from a wall of the flexible polymeric container, the fill tube exit directing the albumin into the cavity of the container distal the periphery of the opening of the container, and the fill tube maintaining the albumin in the fill tube a distance from the fill tube exit during filling suspension; and, sealing the opening of the container within the aseptic area of the packaging machine to retain the albumin within the cavity of the container.

29. The method of claim 28, further comprising the step of providing a sheath exterior to a portion of the filling assembly, the sheath limiting contact between the polymeric container and the filling assembly.

30. A process of packaging albumin in a flexible polymeric container, comprising the steps of:

providing a concentrate of albumin;

providing a packaging machine having a forming assembly, a filling assembly, and a sealing assembly, each of which is located within an interior aseptic environment of the packaging machine;

providing a flexible polymeric film;

forming the flexible polymeric film into an elongated tube with the forming assembly;

sealing a portion of the elongated tube of polymeric film with the sealing assembly, the sealed polymeric film being dimensioned in the shape of a bag having seal areas about a periphery thereof, a cavity located within the bag and between the seal areas, and an opening extending from the cavity to an exterior of the bag;

filling the bag with albumin under a solution line pressure through the filling assembly, the filling assembly having a fill tube extending through the opening of the bag and into the cavity of the bag, and a sheath concentric to an exterior of the fill tube, the fill tube directing the albumin into an interior of the bag a distance away from a periphery of the opening of the bag, and the sheath limiting contact between the fill tube and the bag; and, sealing the opening of the bag to retain the albumin within the cavity of the bag.

31. The process of claim 30, wherein the seal areas are provided about the entire periphery of the bag except for the opening.

32. The process of claim 30, further comprising converting the tube into a plurality of adjacent bags.

33. The process of claim 32, further comprising sealing at least three sides of the bags.

34. The process of claim 32, further comprising sequentially filling the bags with the quantity of albumin.

35. The process of claim 34, further comprising sequentially sealing the opening of the bags.

36. The process of claim 30, wherein the filling step comprises providing a filler having a tip with concentric first and second interior passageways, the first interior passageway having a cross-sectional area greater than a cross-sectional area of the second interior passageway, wherein an interface between the first and second interior passageways is interior of an exterior of the tip, wherein the second interior passageway extends to the exterior of the tip, wherein the albumin exits the filler through the second interior passageway, and wherein the albumin is maintained at the interface between the first and second interior passageways during a suspension of filling.

* * * * *